US006959559B2

(12) United States Patent
Nam et al.

(10) Patent No.: US 6,959,559 B2
(45) Date of Patent: Nov. 1, 2005

(54) TEMPERATURE CONTROL METHOD FOR REFRIGERATOR

(75) Inventors: Young Sok Nam, Seoul (KR); Seong Ho Cho, Seoul (KR); Yun Chul Jung, Kwangmyung-si (KR); Jay Ho Choi, Seoul (KR)

(73) Assignee: LG Electronics, Inc., Seoul (KR)

( * ) Notice: Subject to any disclaimer, the term of this patent is extended or adjusted under 35 U.S.C. 154(b) by 142 days.

(21) Appl. No.: 10/703,586

(22) Filed: Nov. 10, 2003

(65) Prior Publication Data

US 2004/0188935 A1 Sep. 30, 2004

(30) Foreign Application Priority Data

Mar. 31, 2003 (KR) ..... 10-2003-0020203

(51) Int. Cl.[7] ..... F25D 17/08
(52) U.S. Cl. ..... 62/187; 62/180; 62/408
(58) Field of Search ..... 62/179, 180, 186, 62/187, 407, 408, 414

(56) References Cited

U.S. PATENT DOCUMENTS 5,487,277 A * 1/1996 Bessler ..... 62/187
5,555,736 A * 9/1996 Wills et al. ..... 62/187
5,983,654 A * 11/1999 Yamamoto et al. ..... 62/187
6,694,761 B2 * 2/2004 Cho et al. ..... 62/186
6,772,601 B1 * 8/2004 Davis et al. ..... 62/187
6,779,353 B2 * 8/2004 Hu et al. ..... 62/180

* cited by examiner

*Primary Examiner*—Harry B. Tanner
(74) *Attorney, Agent, or Firm*—Fleshner & Kim, LLP

(57) ABSTRACT

Disclosed is a temperature control method for a refrigerator which can minimize a deviation in refrigerant compartment temperature while minimizing the power consumption of the refrigerator. The temperature control method includes the steps of (A) comparing a sensed temperature of a freezing compartment with a predetermined maximum freezing compartment temperature and a predetermined minimum freezing compartment temperature, respectively, thereby controlling a compressor and a circulating fan to be turned on or off such that the sensed freezing compartment temperature is ranged between the predetermined maximum and minimum freezing temperatures, (B) comparing, following the step (A), a sensed temperature of a refrigerating compartment defined with a plurality of refrigerating chambers therein, with a predetermined maximum refrigerating compartment temperature and a predetermined minimum refrigerating compartment temperature, respectively, thereby controlling a damper to be opened or closed and the circulating fan to be turned on or off such that the sensed refrigerating compartment temperature is ranged between the predetermined maximum and minimum refrigerating temperatures, and (C) discharging cold air into at least one of the refrigerating chambers when the damper is closed, and the compressor and the circulating fan are turned on.

20 Claims, 10 Drawing Sheets

TEMPERATURE CONTROL METHOD FOR REFRIGERATOR

BACKGROUND OF THE INVENTION

1. Field of the Invention

The present invention relates to a temperature control method for a refrigerator, and more particularly to a temperature control method for a refrigerator which can supply cold air to insufficiently cooled regions in a refrigerating compartment of the refrigerator without an additional turning-on of a compressor and circulating fan included in the refrigerator, thereby being capable of minimizing a temperature deviation of the refrigerating compartment while minimizing the power consumption of the refrigerator.

2. Description of the Related Art

Generally, a refrigerator is an apparatus in which freezing and refrigerating compartments are maintained at desired low temperatures by a refrigerant cooling cycle consisting of a compressor, a condenser, a capillary valve, and an evaporator.

FIG. 1 is a perspective view of a conventional refrigerator, illustrating the condition in which freezing and refrigerating compartments are in an opened state.

As shown in FIG. 1, the conventional refrigerator includes a refrigerator body in which a freezing compartment F and a refrigerating compartment R are defined by a barrier 2 at opposite sides of the barrier 2, respectively. A freezing compartment door 4 is hingably mounted to the refrigerator body in front of the freezing compartment F. A refrigerating compartment door 6 is also hingably mounted to the refrigerator body in front of the refrigerating compartment R.

FIG. 2 is a front view showing the inner structure of the conventional refrigerator. FIG. 3 is a side view showing the inner structure of the refrigerating compartment in the conventional refrigerator.

An evaporator 8 is installed in rear of the freezing compartment F. The evaporator 8 absorbs heat from air in the freezing compartment F or refrigerating compartment R through heat exchange between the air and a refrigerant passing through the evaporator 8. In accordance with the heat absorption, the refrigerant evaporates. A circulating fan 10 is also installed in rear of the freezing compartment F in order to forcibly convect the air, cooled in accordance with the heat absorption of the evaporator 8, into the freezing compartment F or refrigerating compartment R.

The freezing compartment F is provided, at the upper portion of a rear wall thereof, with cold air discharge holes 12 adapted to discharge the air cooled by the evaporator 8, that is, cold air, into the freezing compartment F in accordance with the operation of the circulating fan 10. The freezing compartment F is also provided, at the lower portion of the rear wall thereof, with cold air return holes 14 adapted to return the cold air, used to cool the freezing compartment F to a desired freezing temperature, to the evaporator 8.

The freezing compartments F is partitioned into a plurality of freezing chambers F1 to F6. A plurality of shelves 15 to 19 are installed in the freezing chamber F such that they are vertically spaced apart from one another. Food or containers may be laid on the shelves 15 to 19.

The barrier 2 is provided, at its upper portion, with a cold air discharge duct 21 for partially discharging the cold air produced by the evaporator 8 into the refrigerating compartment R in accordance with the operation of the circulating fan 10. The barrier 2 is also provided, at its lower portion, with a cold air return duct 22 for returning the cold air, used to cool the freezing compartment F to a desired freezing temperature, to the evaporator 8.

A damper 24 is installed at one side of the cold air discharge duct 21 or at the upper portion of the refrigerating compartment R. The damper 24 is opened or closed to determine whether nor not the cold air has to be discharged into the refrigerating compartment R.

On the other hand, the refrigerating compartment R is partitioned into a plurality of refrigerating chambers R1 to R6. A plurality of refrigerating compartment shelves 25 to 28 are installed in the refrigerating chamber R such that they are vertically spaced apart from one another. Food or containers may be laid on the refrigerating compartment shelves 25 to 28.

A plurality of baskets 31 to 35 adapted to receive food or containers are mounted to the back surface of the refrigerating compartment door 6 such that they are vertically spaced apart from one another.

The refrigerating compartment shelves 25 to 29 are spaced apart from the baskets 31 to 35 respectively arranged adjacent thereto and from the back surface of the refrigerating compartment door 6, so as to define a cold air passage.

The reference numeral 44 designates a freezing compartment temperature sensor for sensing a temperature at one side of the freezing compartment F, and the reference numeral 45 designates a refrigerating compartment temperature sensor for sensing a temperature at one side of the refrigerating compartment R.

FIG. 4 is a control block diagram of the conventional refrigerator.

As shown in FIG. 3, the conventional refrigerator further includes a compressor 41 for compressing a gaseous refrigerant of low temperature and low pressure emerging from the evaporator 8, thereby producing a gaseous refrigerant of high temperature and high pressure, a condenser for discharging heat from the gaseous refrigerant of high temperature and high pressure into the atmosphere, thereby condensing the gaseous refrigerant to produce a liquid refrigerant of intermediate temperature and high pressure, a capillary valve for reducing the pressure of the high-pressure liquid refrigerant emerging from the condenser, and a compressor cooling fan 42 for cooling the compressor 41 in order to prevent the compressor 41 from over-heating.

The refrigerator also includes a temperature setting unit 43 for setting predetermined maximum and minimum temperatures of the freezing and refrigerating compartments F and R, and a control unit 46 for comparing sensed temperatures of the freezing and refrigerating compartments F and R with the predetermined maximum and minimum temperatures associated therewith, respectively, thereby controlling the opening/closing of the damper 24 and the turning-on/off of the circulating fan 10, compressor 41, and compressor cooling fan 42.

The predetermined maximum and minimum temperatures may be set to correspond to a temperature obtained by adding a predetermined temperature tolerance to a desired temperature set by the user, and a temperature obtained by deducting the predetermined temperature tolerance from the set temperature, respectively. Alternatively, the predetermined maximum and minimum temperatures may be independently set.

Now, a temperature control method for the conventional refrigerator having the above mentioned configuration will be described.

FIG. 5 is a flow chart illustrating the temperature control method for the conventional refrigerator.

First, the control unit 46 compares the temperature $T_f$ of the freezing compartment F sensed by the freezing compartment temperature sensor 44 with the predetermined maximum temperature $T_f$max of the freezing compartment F (S1).

The predetermined maximum freezing compartment temperature $T_f$max corresponds to a temperature obtained by adding a predetermined temperature tolerance to a desired freezing compartment temperature set by the user.

The control unit 46 turns on the circulating fan 10, compressor 41, and compressor cooling fan 42 when it determines that the temperature $T_f$ of the freezing compartment F is equal to or more than the predetermined maximum temperature $T_f$max of the freezing compartment F (S2).

When the circulating fan 10 and compressor 41 are turned on, air present in the freezing compartment F circulates between the evaporator 20 and the freezing compartment F, thereby causing the freezing compartment F to be cooled to a desired freezing temperature.

Thereafter, the control unit 46 compares the temperature $T_r$ of the refrigerating compartment R sensed by the refrigerating compartment temperature sensor 45 with the predetermined maximum temperature $T_r$max of the refrigerating compartment R (S3).

The predetermined maximum refrigerating compartment temperature $T_r$max corresponds to a temperature obtained by adding a predetermined temperature tolerance to a desired refrigerating compartment temperature set by the user.

The control unit 46 opens the damper 24 when it determines that the temperature $T_r$ of the refrigerating compartment R is equal to or more than the predetermined maximum temperature $T_r$max of the refrigerating compartment R (S4).

When the damper 24 is opened, a part of the air cooled by the evaporator 8 is discharged into the refrigerating compartment R via the cold air discharge duct 21. The discharged cold air cools the interior of the refrigerating compartment R to a desired refrigerating temperature while being convected in the interior of the refrigerating compartment R. Subsequently, the cold air flows toward the lower portion of the refrigerating compartment R, and then returns to the evaporator 8 through the cold air return duct 22.

On the other hand, if it is determined at step S3 that the temperature $T_r$ of the refrigerating compartment R is less than the predetermined maximum temperature $T_r$max of the refrigerating compartment R, the control unit 46 then compares the temperature $T_r$ of the refrigerating compartment R with the predetermined minimum temperature $T_r$min of the refrigerating compartment R (S5).

The predetermined minimum refrigerating compartment temperature $T_r$min corresponds to a temperature obtained by deducting a predetermined temperature tolerance to a desired refrigerating compartment temperature set by the user.

The control unit 46 closes the damper 24 when it determines that the temperature $T_r$ of the refrigerating compartment R is less than the predetermined minimum temperature $T_r$min of the refrigerating compartment R (S6).

When the damper 24 is closed, the cold air is discharged into the refrigerating compartment R no longer. Accordingly, the interior of the refrigerating compartment R is not over-cooled.

On the other hand, if it is determined at step S1 that the temperature $T_f$ of the freezing compartment F is less than the predetermined maximum temperature $T_f$max of the freezing compartment F, the control unit 46 then compares the temperature $T_f$ of the freezing compartment F with the predetermined minimum temperature $T_f$min of the freezing compartment F (S7).

The predetermined minimum freezing compartment temperature $T_f$min corresponds to a temperature obtained by deducting a predetermined temperature tolerance to a desired freezing compartment temperature set by the user.

When it is determined that the temperature $T_f$ of the freezing compartment F is less than the predetermined maximum temperature $T_f$max of the freezing compartment F, the control unit 46 turns off the compressor 41 and compressor cooling fan 42.

In the OFF state of the compressor 41, the refrigerant temperature of the evaporator 20 increases with the lapse of time. As a result, the temperature of the cold air circulating between the freezing compartment F and the evaporator 8 is increased due to a load in the freezing compartment F, so that the interior of the freezing compartment F is not over-cooled.

Thereafter, the control unit 46 again compares the temperature $T_r$ of the refrigerating compartment R sensed by the refrigerating compartment temperature sensor 45 with the predetermined maximum temperature $T_r$max of the refrigerating compartment R (S9).

When it is determined that the temperature $T_r$ of the refrigerating compartment R is equal to or more than the predetermined maximum temperature $T_r$max of the refrigerating compartment R, the control unit 46 again opens the damper 24, and again turns on the circulating fan (S10).

When the damper 24 is opened, and the circulating fan 10 is turned on, a part of the air cooled by the evaporator 8 is discharged into the refrigerating compartment R via the cold air discharge duct 21. The discharged cold air cools the interior of the refrigerating compartment R to a desired refrigerating temperature while being convected in the interior of the refrigerating compartment R. Subsequently, the cold air flows toward the lower portion of the refrigerating compartment R, and then returns to the evaporator 8 through the cold air return duct 22.

On the other hand, if it is determined at step S9 that the temperature $T_r$ of the refrigerating compartment R is less than the predetermined maximum temperature $T_r$max of the refrigerating compartment R, the control unit 46 then again compares the temperature $T_r$ of the refrigerating compartment R with the predetermined minimum temperature $T_r$min of the refrigerating compartment R (S11).

The control unit 46 again closes the damper 24 and turns off the circulating fan 10 when it determines that the temperature $T_r$ of the refrigerating compartment R is less than the predetermined minimum temperature $T_r$min of the refrigerating compartment R (S12).

When the damper 24 is closed, and the circulating fan 10 is turned off, the cold air is discharged into the refrigerating compartment R no longer. Accordingly, the interior of the refrigerating compartment R is not over-cooled.

However, the above mentioned convention refrigerator temperature control method has a limitation in uniformly convecting the cold air, discharged into the refrigerating compartment R, in the interior of the refrigerating compartment R. For this reason, in the refrigerating compartment R, there may be an insufficiently cooled region where convection of the cold air is ineffectively carried out. As a result, there may be a temperature deviation in the refrigerating compartment R.

In order to eliminate such a temperature deviation in the refrigerating compartment R, a proposal for separately discharging cold air into the insufficiently cooled region has been made. In accordance with this proposal, a second cold air discharge duct is provided in the interior of the barrier 2, and a nozzle is connected to the second cold air discharge duct while being arranged such that it injects cold air into the insufficiently cooled region. In accordance with such a configuration, it is possible to more or less reduce the temperature deviation of the refrigerating compartment R caused by the non-uniform cold air convection. However, such a temperature deviation reduction is low in a state in which both the nozzle and the damper 24 are opened.

SUMMARY OF THE INVENTION

The present invention has been made in view of the above mentioned problems involved with the related art, and an object of the invention is to provide a temperature control method for a refrigerator which can minimize a deviation in refrigerant compartment temperature while minimizing the power consumption of the refrigerator.

In accordance with one aspect, the present invention provides a temperature control method for a refrigerator comprising the steps of: (A) comparing a sensed temperature of a freezing compartment defined in the refrigerator with a predetermined maximum freezing compartment temperature and a predetermined minimum freezing compartment temperature, respectively, thereby controlling a compressor and a circulating fan included in the refrigerator to be turned on or off such that the sensed freezing compartment temperature is ranged between the predetermined maximum and minimum freezing temperatures; (B) comparing, following the step (A), a sensed temperature of a refrigerating compartment, defined in the refrigerator while being defined with a plurality of refrigerating chambers therein, with a predetermined maximum refrigerating compartment temperature and a predetermined minimum refrigerating compartment temperature, respectively, thereby controlling a damper included in the refrigerator to be opened or closed and the circulating fan to be turned on or off such that the sensed refrigerating compartment temperature is ranged between the predetermined maximum and minimum refrigerating temperatures; and (C) discharging cold air into at least one of the refrigerating chambers when the damper is closed at the step (B) under a condition in which the compressor and the circulating fan are turned on at the step (A).

In accordance with another aspect, the present invention provides a temperature control method for a refrigerator comprising the steps of: (A) comparing a sensed temperature of a freezing compartment defined in the refrigerator with a predetermined maximum freezing compartment temperature and a predetermined minimum freezing compartment temperature, respectively, thereby controlling a compressor and a circulating fan included in the refrigerator to be turned on or off such that the sensed freezing compartment temperature is ranged between the predetermined maximum and minimum freezing temperatures; (B) comparing, following the step (A), a sensed temperature of a refrigerating compartment, defined in the refrigerator while being defined with a plurality of refrigerating chambers therein, with a predetermined maximum refrigerating compartment temperature and a predetermined minimum refrigerating compartment temperature, respectively, thereby controlling a damper included in the refrigerator to be opened or closed and the circulating fan to be turned on or off such that the sensed refrigerating compartment temperature is ranged between the predetermined maximum and minimum refrigerating temperatures; and (C) discharging cold air into at least one of the refrigerating chambers in response to an opening signal outputted from a nozzle timer included in the refrigerator when the damper is closed at the step (B) under a condition in which the compressor and the circulating fan are turned on at the step (A).

BRIEF DESCRIPTION OF THE DRAWINGS

The above objects, and other features and advantages of the present invention will become more apparent after reading the following detailed description when taken in conjunction with the drawings, in which.

DESCRIPTION OF THE PREFERRED EMBODIMENTS

Now, preferred embodiments of the present invention will be described in detail with reference to the annexed drawings.

Figure 6:
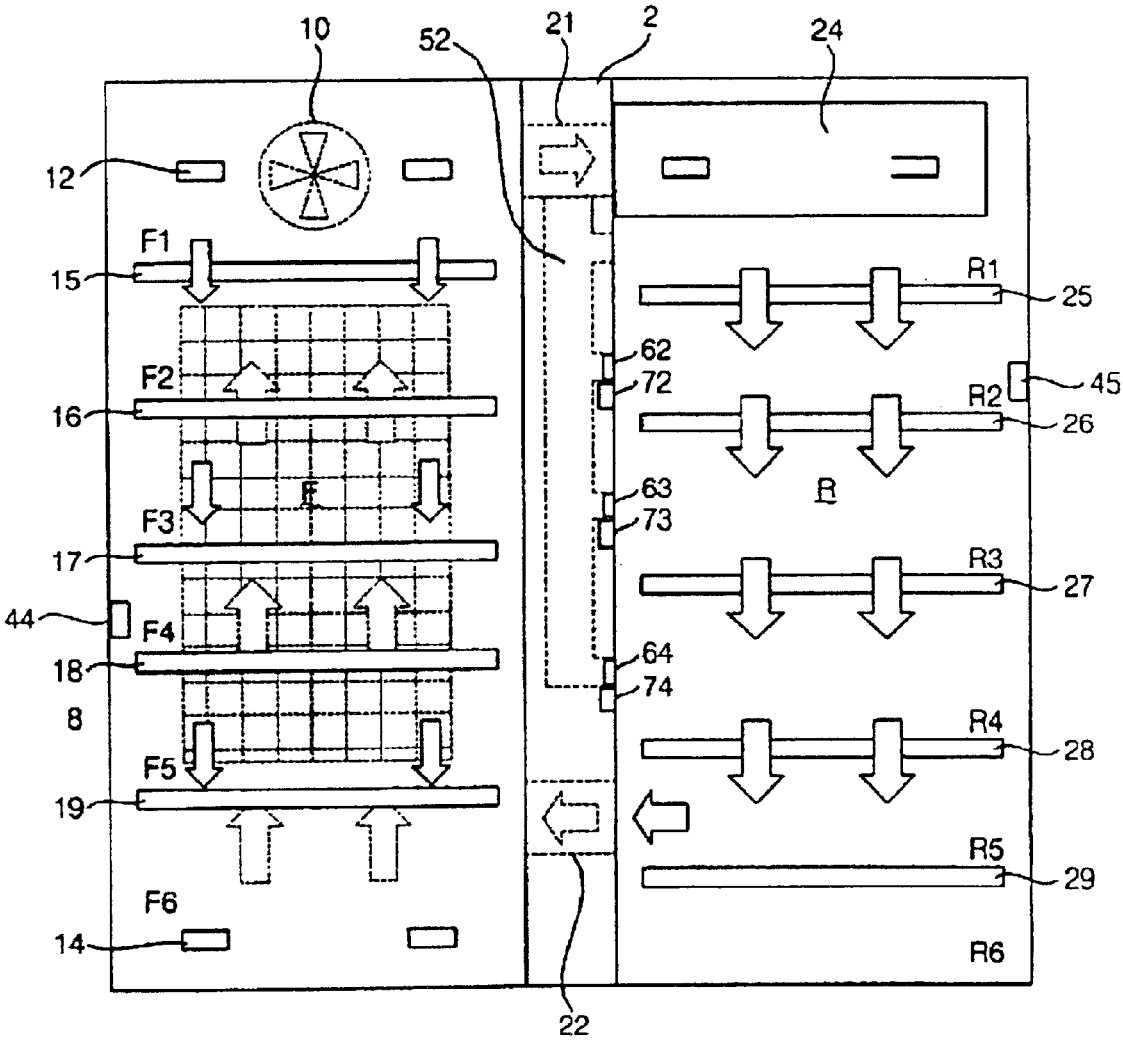
FIG. 6 is a front view illustrating the inner structure of a refrigerator according to the present invention.
Figure 7:
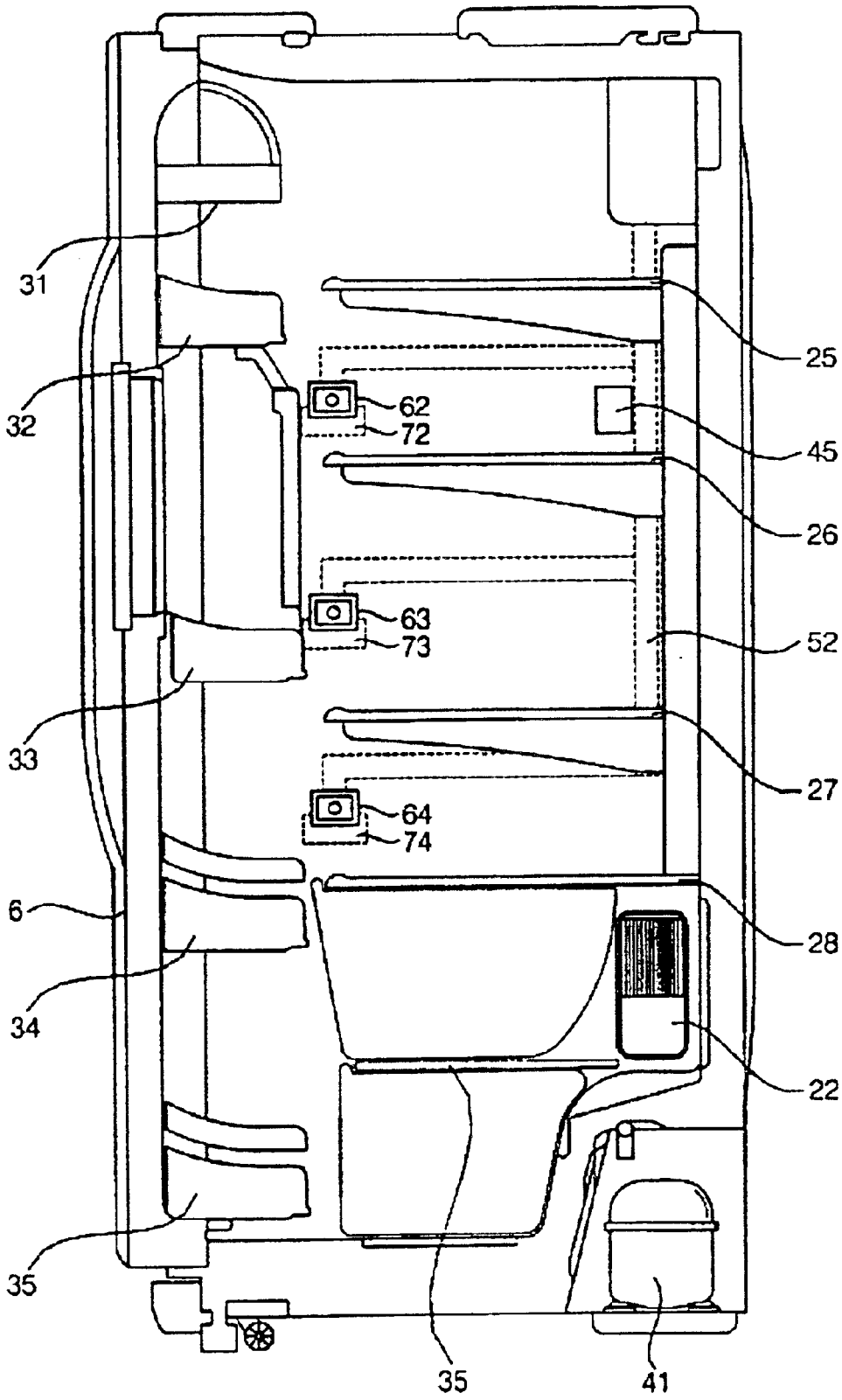
Fig. 7(Prior art)
FIG. 7 is a side view illustrating the inner structure of a refrigerating compartment in the refrigerator according to the present invention.

FIG. 6 is a front view illustrating the inner structure of a refrigerator according to the present invention. FIG. 7 is a side view illustrating the inner structure of a refrigerating compartment in the refrigerator according to the present invention.

Figure 1:
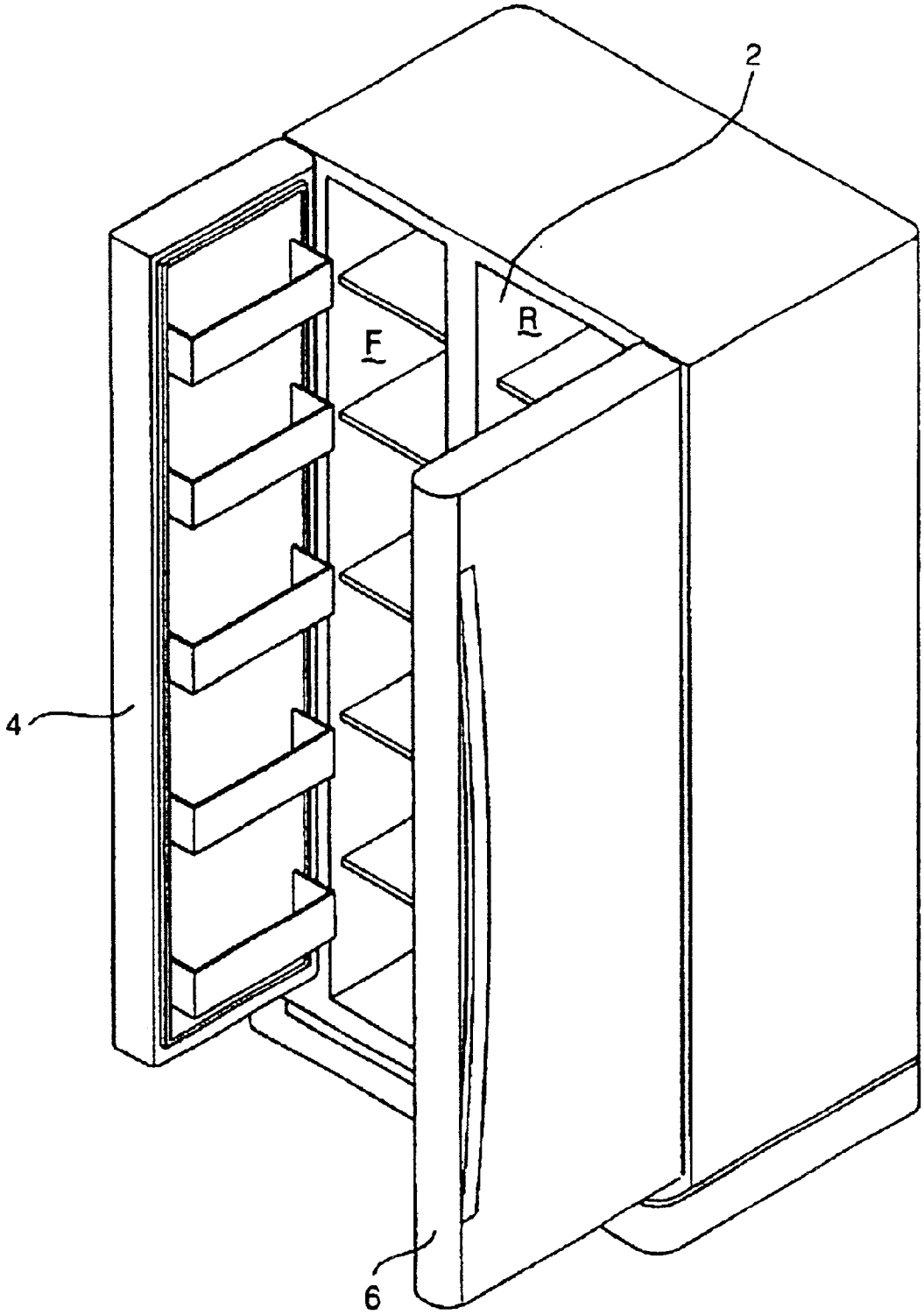
Fig. 1(Prior art)
FIG. 1 is a perspective view of a conventional refrigerator, illustrating the condition in which freezing and refrigerating compartments are in an opened state.
Figure 2:
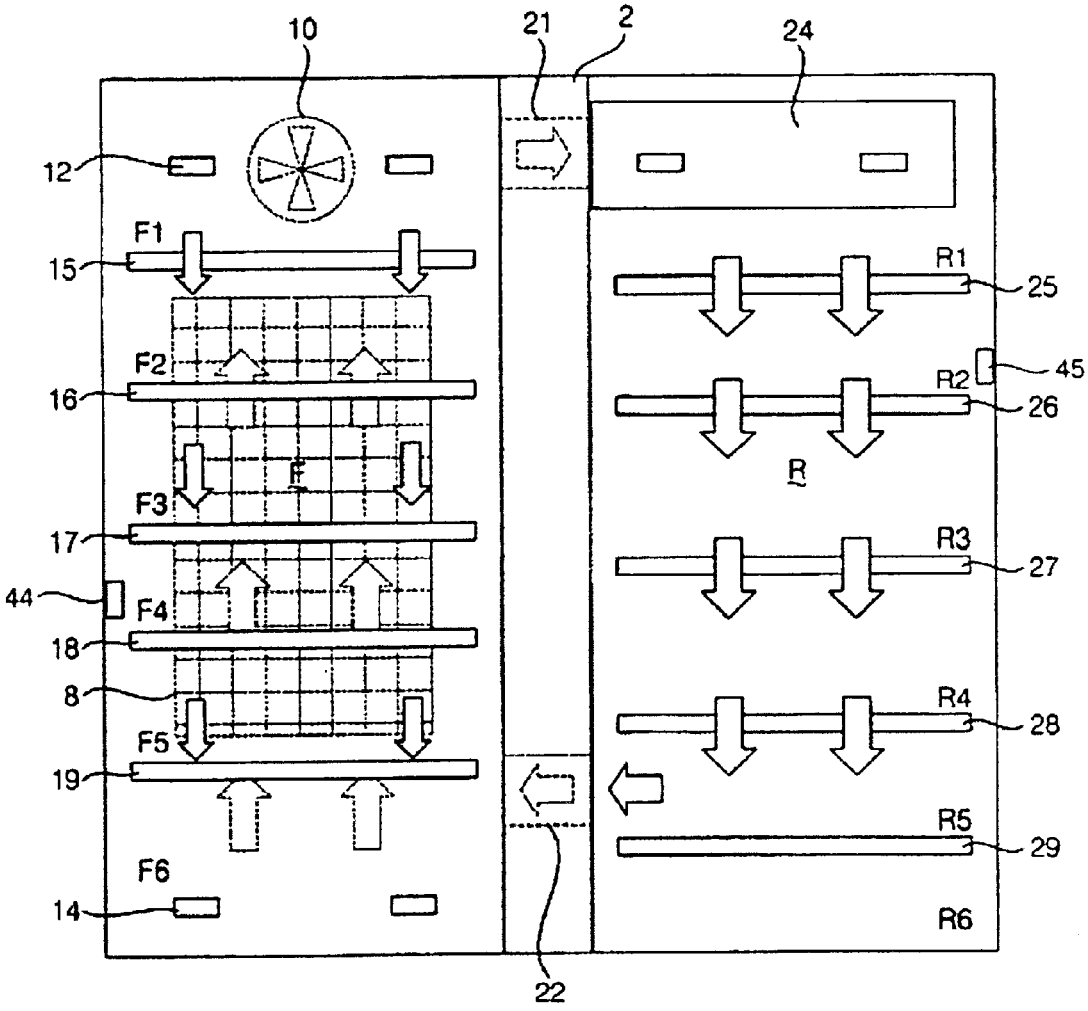
Fig. 2 (Prior art)
FIG. 2 is a front view showing the inner structure of the conventional refrigerator.
Figure 3:
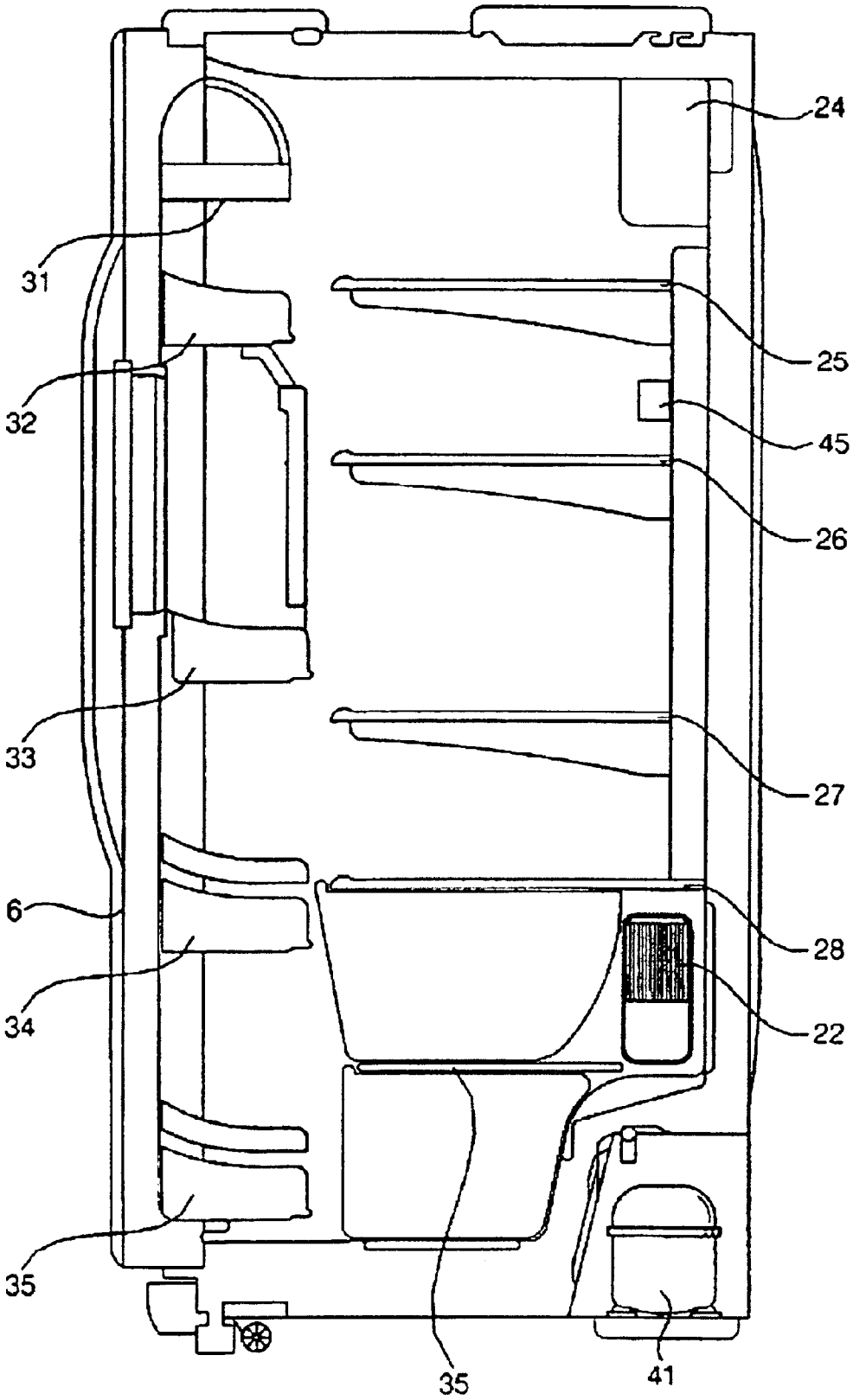
Fig. 3(Prior art)
FIG. 3 is a side view showing the inner structure of the refrigerating compartment in the conventional refrigerator.
Figure 4:
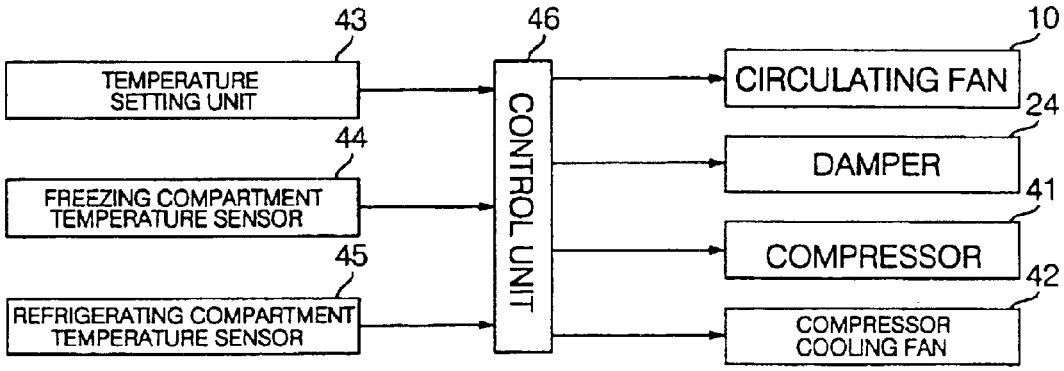
Fig. 4(Prior art)
FIG. 4 is a control block diagram of the conventional refrigerator.
Figure 5:
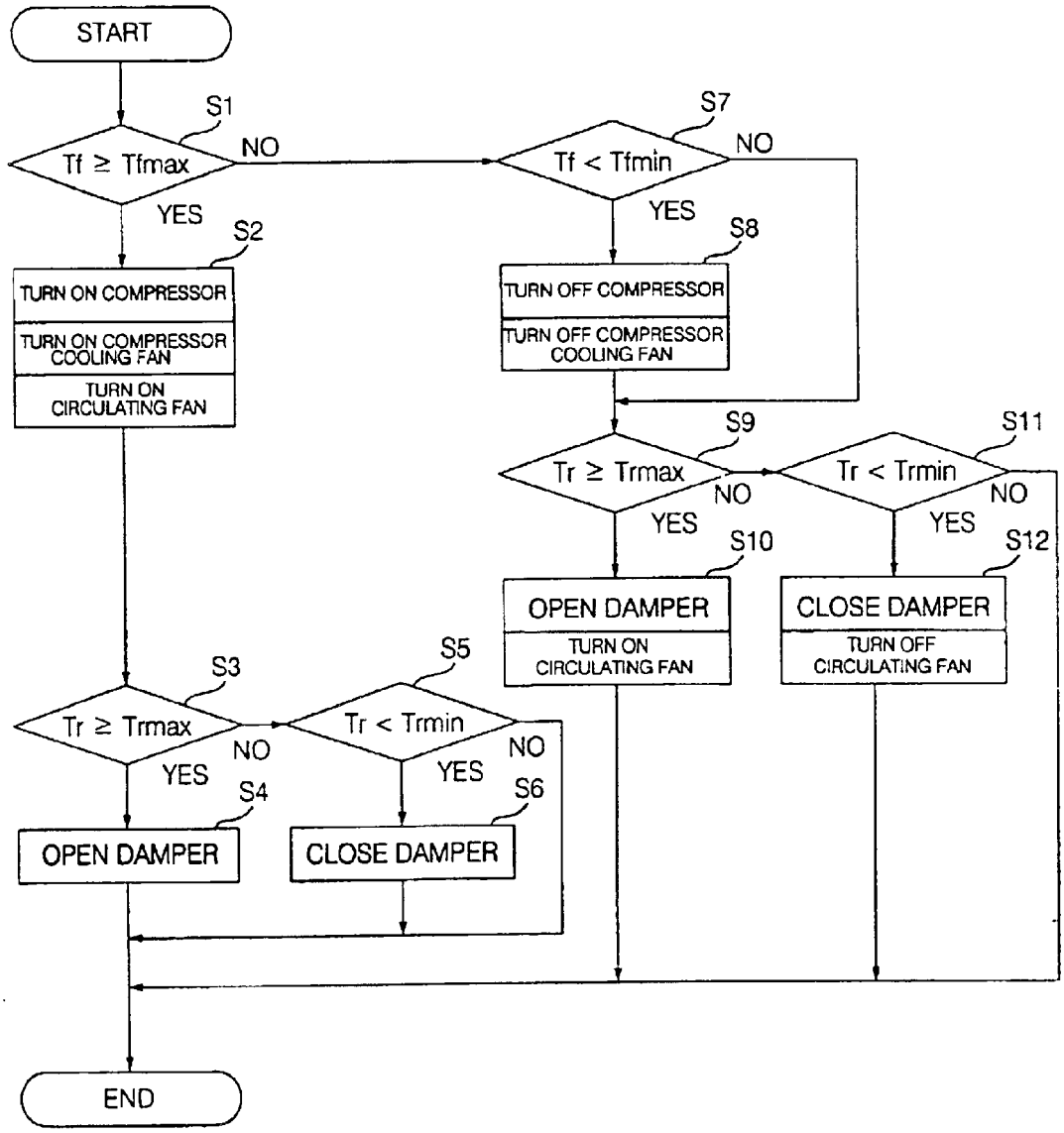
Fig. 5(Prior art)
FIG. 5 is a flow chart illustrating a temperature control method for the conventional refrigerator.

The refrigerator of the present invention shown in FIGS. 6 and 7 has the same basic structure as that of the conventional refrigerator shown in FIGS. 2 and 3. Constituent elements included in the basic structure shown in FIGS. 6 and 7 are designated by the same reference numerals as those of FIGS. 2 and 3, respectively, and no detailed description thereof will be given. In the refrigerator of the present invention, as shown in FIGS. 6 and 7, a second cold air discharge duct 52 is formed at the barrier 2 such that it communicates, at one end thereof, with the cold air discharge duct 21 while communicating, at the other end thereof, with a part of the refrigerating chambers R1 to R6, for example, the refrigerating chambers R2, R3, and R4. Nozzles 62 to 64 are mounted to the other end of the second cold air discharge duct 52 in order to inject cold air, passing through the second cold air discharge duct 52, into the refrigerating chambers R2 to R4, respectively. Nozzle motors 72 to 74 are coupled to respective nozzles 62 to 64. Each of the nozzle motors 72 to 74 serves to rotate an associated one of the nozzles 62 to 64 between a closed position where the outlet of the associated nozzle is directed toward the barrier 2 and an opened position where the outlet of the associated nozzle is directed toward an associated one of the refrigerating chamber R2 to R4. The refrigerator of the present invention has the same structure as that of the conventional refrigerator, except for the second cold air discharge duct 52, nozzles 62 to 64, and nozzle motors 72 to 74.

Figure 8:
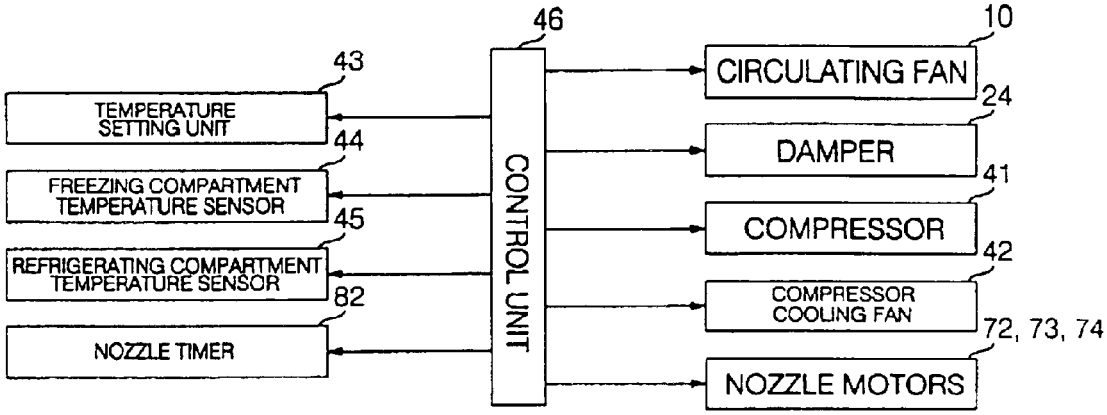
FIG. 8 is a control block diagram of the refrigerator according to the present invention.

FIG. 8 is a control block diagram of the refrigerator according to the present invention.

Under the condition in which both the circulating fan 10 and the compressor 41 are in their ON state, and the damper 24 is in its closed state, the control unit 46 turns on the nozzle motors 72 to 74 in order to open respective outlets of the nozzles 62 to 64.

The refrigerator according to the illustrated embodiment of the present invention further includes a nozzle timer 82 for periodically outputting an opening signal and a closing signal in order to open and close the nozzles 62 to 64 at intervals of a predetermined time. When the nozzle timer 82 outputs an opening signal under the condition in which both the circulating fan 10 and the compressor 41 are in their ON state, and the damper 24 is in its closed state, the control unit 46 turns on the nozzle motors 72 to 74 to open respective outlets of the nozzles 62 to 64.

Figure 9:
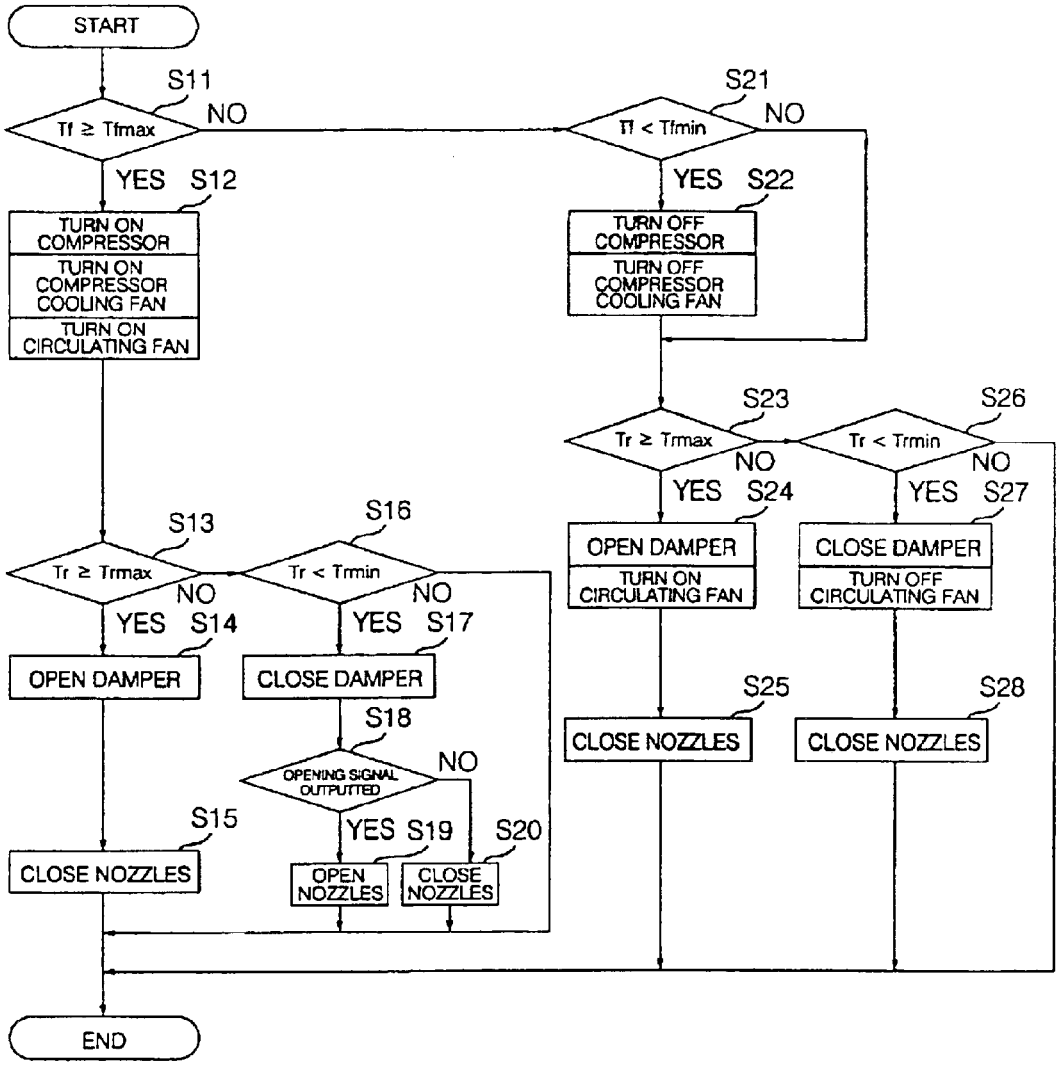
FIG. 9 is a flow chart illustrating a temperature control method for the refrigerator having the above described configuration in accordance with an embodiment of the present invention.

FIG. 9 is a flow chart illustrating a temperature control method for the refrigerator having the above described configuration in accordance with an embodiment of the present invention.

First, the control unit 46 compares the temperature $T_f$ of the freezing compartment F sensed by the freezing compartment temperature sensor 44 with the predetermined maximum temperature $T_f$max of the freezing compartment F (S11).

When it is determined at step S11 that the temperature $T_f$ of the freezing compartment F is equal to or more than the predetermined maximum temperature $T_f$max of the freezing compartment F, the control unit 46 turns on the circulating fan 10 and compressor 41 (S12).

The control unit 46 also turns on the compressor cooling fan 42, simultaneously with the turning-on of the compressor 41.

When the circulating fan 10 and compressor 41 are turned on, air present in the freezing compartment F circulates between the evaporator 20 and the freezing compartment F, thereby causing the freezing compartment F to be cooled to a desired freezing temperature.

Thereafter, the control unit 46 compares the temperature $T_r$ of the refrigerating compartment R sensed by the refrigerating compartment temperature sensor 45 with the predetermined maximum temperature $T_r$max of the refrigerating compartment R (S13).

The control unit 46 opens the damper 24 when it determines that the temperature $T_r$ of the refrigerating compartment R is equal to or more than the predetermined maximum temperature $T_r$max of the refrigerating compartment R (S14).

When the damper 24 is opened, a part of the air cooled by the evaporator 8 is discharged into the upper portion of the refrigerating compartment R via the cold air discharge duct 21. The discharged cold air cools the interior of the refrigerating compartment R to a desired refrigerating temperature while being convected in the interior of the refrigerating compartment R. Subsequently, the cold air flows toward the lower portion of the refrigerating compartment R, and then returns to the evaporator 8 through the cold air return duct 22.

During the above operation, the control unit 46 also controls the nozzle motors 72 to 74 to cause respective outlets of the nozzles 62 to 64 to are directed toward the barrier 2, irrespective of an opening/closing signal from the nozzle timer 82 (S15). Accordingly, the nozzles 62 to 64 are maintained in their closed state.

In the closed state of the nozzles 62 to 64, the cold air passing through the cold air discharge duct 21 cannot be injected into the refrigerating chambers R2, R3, and R4 through the nozzles 62 to 64. That is, the whole part of the cold air is discharged into the upper portion of the refrigerating compartment R. The cold air introduced into the refrigerating compartment R cools the interior of the refrigerating compartment R to a desired refrigerating temperature while being convected throughout the interior of the refrigerating compartment R.

On the other hand, if it is determined at step S13 that the temperature $T_r$ of the refrigerating compartment R is less than the predetermined maximum temperature $T_r$max of the refrigerating compartment R, the control unit 46 then compares the temperature $T_r$ of the refrigerating compartment R with the predetermined minimum temperature $T_r$min of the refrigerating compartment R (S16).

The control unit 46 closes the damper 24 when it determines that the temperature $T_r$ of the refrigerating compartment R is less than the predetermined minimum temperature $T_r$min of the refrigerating compartment R (S17).

When the damper 24 is closed, the cold air is discharged into the refrigerating compartment R no longer. Accordingly, the interior of the refrigerating compartment R is not overcooled.

Meanwhile, under the condition in which both the circulating fan 10 and the compressor 41 are in their ON state, and the damper 24 is in its closed state, the control unit 46 controls the nozzle motors 72 to 74 to cause respective outlets of the nozzles 62 to 64 to be directed toward the refrigerating chambers R2, R3, and R4 (S19). In this state, the nozzles 62 to 64 are opened.

Alternatively, the control unit 46 may be configured to control the nozzle motors 72 to 74 to cause respective outlets of the nozzles 62 to 64 to be directed toward the refrigerating chambers R2, R3, and R4, in response to an opening signal outputted from the nozzle timer 82 under the condition in which both the circulating fan 10 and the compressor 41 are in their ON state, and the damper 24 is in its closed state (S18 and S19).

That is, it may be possible to determine whether or not the nozzles 62 to 64 have to be opened, only based on the states of the circulating fan 10, compressor 41, and damper 24. Alternatively, this determination may be achieved, based on the operation of the nozzle timer 82 in addition to the states of the circulating fan 10, compressor 41, and damper 24.

When the nozzles 62 to 64 are opened, the cold air, which has been confined in the second cold air discharge duct 52 due to the closed state of the damper 24, is discharged into the refrigerating chambers R2, R3 and R4 through the opened nozzles 62 to 64, respectively.

The discharged cold air cools the refrigerating chambers R2, R3, and R4 to a desired refrigerating temperature.

Subsequently, the cold air flows toward the lower portion of the refrigerating compartment R, and then returns to the evaporator 8 through the cold air return duct 22.

Thus, it is possible to cool, to a desired refrigerating temperature, insufficiently cooled regions formed when the temperature $T_r$ of the refrigerating compartment R is less than the predetermined maximum temperature $T_r$max of the refrigerating compartment R, without additional operations of the compressor 41 and circulating fan 10.

When the control unit 46 is configured to take into consideration the opening/closing signal outputted from the nozzle timer 82 in determining the opening/closing of the nozzles 62 to 64, it controls the nozzle motors 72 to 74 so that the outlets of the nozzles 62 to 64 are directed toward the barrier 2 in response to a closing signal outputted from the nozzle timer 82, even when both the circulating fan 10 and the compressor 41 are in their ON state, and the damper 24 is in its closed state (S18 and S20).

In the closed state of the nozzles 62 to 64, no cold air is discharged into the refrigerating chambers R2, R3 and R4 through the nozzles 62 to 64. Accordingly, the refrigerating chambers R2, R3, and R4 are not over-cooled.

Thus, it is possible to minimize the temperature deviation of the refrigerating compartment while preventing the insufficiently cooled regions from being over-cooled, by discharging cold air into the insufficiently cooled regions only in response to an opening signal outputted from the nozzle timer 82, that is, only when the nozzle timer 82 is in its ON state.

On the other hand, if it is determined at step S11 that the temperature $T_f$ of the freezing compartment F is less than the predetermined maximum temperature $T_f$max of the freezing compartment F, the control unit 46 then compares the temperature $T_f$ of the freezing compartment F with the predetermined minimum temperature $T_f$min of the freezing compartment F (S21).

When it is determined that the temperature $T_f$ of the freezing compartment F is less than the predetermined maximum temperature $T_f$max of the freezing compartment F, the control unit 46 turns off the compressor 41.

The control unit 46 also turns off the compressor cooling fan 42, simultaneously with the turning-off of the compressor 41.

In the OFF state of the compressor 41, the refrigerant temperature of the evaporator 20 increases with the lapse of time. As a result, the temperature of the cold air circulating between the freezing compartment F and the evaporator 8 is increased due to a load in the freezing compartment F, so that the interior of the freezing compartment F is not over-cooled.

Thereafter, the control unit 46 again compares the temperature $T_r$ of the refrigerating compartment R sensed by the refrigerating compartment temperature sensor 45 with the predetermined maximum temperature $T_r$max of the refrigerating compartment R (S23).

When it is determined that the temperature $T_r$ of the refrigerating compartment R is equal to or more than the predetermined maximum temperature $T_r$max of the refrigerating compartment R, the control unit 46 again opens the damper 24, and again turns on the circulating fan (S24).

When the damper 24 is opened, and the circulating fan 10 is turned on, a part of the air cooled by the evaporator 8 is discharged into the refrigerating compartment R via the cold air discharge duct 21. The discharged cold air cools the interior of the refrigerating compartment R to a desired refrigerating temperature while being convected in the interior of the refrigerating compartment R. Subsequently, the cold air flows toward the lower portion of the refrigerating compartment R, and then returns to the evaporator 8 through the cold air return duct 22.

During the above operation, the control unit 46 also controls the nozzle motors 72 to 74 to cause respective outlets of the nozzles 62 to 64 to be directed toward the barrier 2, irrespective of an opening/closing signal from the nozzle timer 82 (S25). Accordingly, the nozzles 62 to 64 are maintained in their closed state.

In the closed state of the nozzles 62 to 64, the cold air passing through the cold air discharge duct 21 cannot be injected into the refrigerating chambers R2, R3, and R4 through the nozzles 62 to 64. That is, the whole part of the cold air is discharged into the upper portion of the refrigerating compartment R. The cold air introduced into the refrigerating compartment R cools the interior of the refrigerating compartment R to a desired refrigerating temperature while being convected throughout the interior of the refrigerating compartment R.

On the other hand, if it is determined at step S23 that the temperature $T_r$ of the refrigerating compartment R is less than the predetermined maximum temperature $T_r$max of the refrigerating compartment R, the control unit 46 then compares the temperature $T_r$ of the refrigerating compartment R with the predetermined minimum temperature $T_r$min of the refrigerating compartment R (S26).

The control unit 46 closes the damper 24 while turning off the circulating fan 10 when it determines that the temperature $T_r$ of the refrigerating compartment R is less than the predetermined minimum temperature $T_r$min of the refrigerating compartment R (S27).

When the damper 24 is closed, and the circulating fan 10 is turned off, the cold air is discharged into the refrigerating compartment R no longer. Accordingly, the interior of the refrigerating compartment R is not over-cooled.

Since the circulating fan 10 is in its OFF state, the control unit 46 controls the nozzle motors 72 to 74 so that respective outlets of the nozzles 62 to 64 are directed toward the barrier 2, irrespective of an opening/closing signal from the nozzle timer 82 (S15). Accordingly, the nozzles 62 to 64 are maintained in their closed state.

In the closed state of the nozzles 62 to 64, the cold air passing through the cold air discharge duct 21 cannot be injected into the refrigerating chambers R2, R3, and R4 through the nozzles 62 to 64. Accordingly, the refrigerating chambers R2, R3, and R4 are not over-cooled.

That is, when the circulating fan 10 is turned off in the closed state of the damper 24, the nozzles 62 to 64 are closed in spite of the closed state of the damper 24. Accordingly, it is possible to prevent the nozzle motors 72 to 74 from operating unnecessarily, thereby preventing an unnecessary increase in power consumption.

Figure 10:
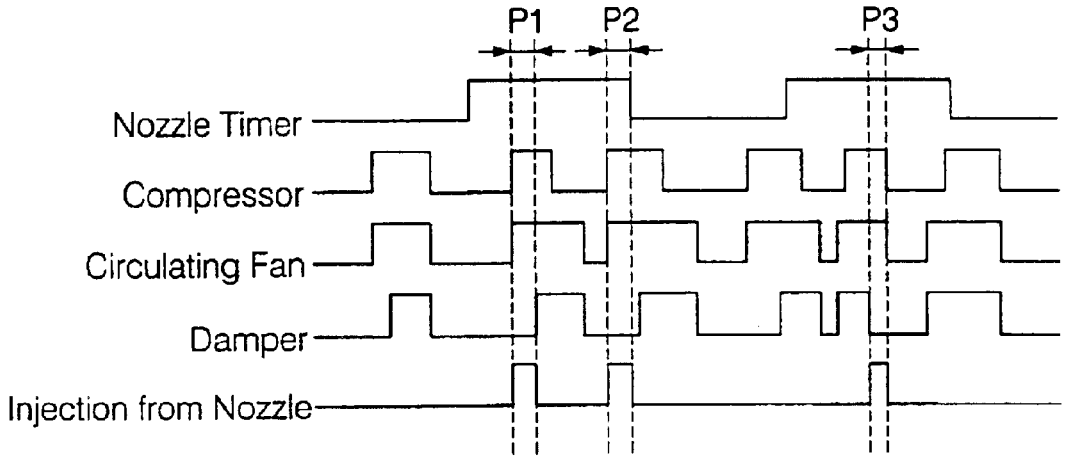
FIG. 10 is a timing diagram illustrating operations of the refrigerator carried out in accordance with the temperature control method of the present invention.

The ON/OFF timing of the compressor 41, circulating fans 10, and damper 24, and the opening/closing timing of the nozzles 62 to 64 are shown in FIG. 10.

FIG. 10 is a timing diagram illustrating operations of the refrigerator carried out in accordance with the temperature control method of the present invention.

In FIG. 10, "P1", "P2" and "P3" are periods in which cold air is discharged through the nozzles 62 to 64, respectively. In the periods P1, P2, and P3, the circulating fan 10, compressor 41, and nozzle timer 82 are in their ON state, whereas the damper 24 is in its OFF (closed) state.

The ON/OFF states of the compressor 41, circulating fans 10, and damper 24, and the opening/closing state of the nozzles 62 to 64 have a relation shown in Table 1.

TABLE 1

| Compressor | Circulating Fan | Damper | Nozzles |
|---|---|---|---|
| ON | ON | ON | Closed |
| ON | ON | OFF | Opened |
| OFF | ON | ON | Closed |
| OFF | OFF | OFF | Closed |

As shown in Table 1 and FIG. 10, cold air is discharged into the insufficiently cooled regions of the refrigerating compartment R when the circulating fan 10 and compressor 41 are in their ON state, and the damper 24 is in its OFF state, or when the nozzle timer is in its ON state under the condition in which the circulating fan 10 and compressor 41 are in their ON state, and the damper 24 is in its OFF state. Accordingly, it is possible to reduce the temperature deviation of the refrigerating compartment R without an additional turning-on of the circulating fan 10 and compressor 41.

As apparent from the above description, in accordance with the refrigerator temperature control method according to the present invention, cold air is discharged into a part of the refrigerating chambers when the circulating fan and compressor are in their ON state, and the damper is in its OFF state. Accordingly, it is possible to reduce a temperature deviation occurring in the refrigerating compartment. Also, such a temperature deviation reduction can be achieved in accordance with opening/closing of the nozzles without additional operations of the compressor and circulating fan. Accordingly, an improvement in power consumption efficiency can be achieved.

Also, cold air may be discharged into a part of the refrigerating chambers in response to an opening signal outputted from the nozzle timer under the condition in which the circulating fan and compressor are in their ON state, and the damper is in its OFF state. In this case, there is an advantage in that it is possible to prevent the refrigerating chambers, supplied with the cold air through the nozzles, from being over-cooled.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. A temperature control method for a refrigerator comprising the steps of:

(A) comparing a sensed temperature of a freezing compartment defined in the refrigerator with a predetermined maximum freezing compartment temperature and a predetermined minimum freezing compartment temperature, respectively, thereby controlling a compressor and a circulating fan included in the refrigerator to be turned on or off such that the sensed freezing compartment temperature is ranged between the predetermined maximum and minimum freezing temperatures;

(B) comparing, following the step (A), a sensed temperature of a refrigerating compartment, defined in the refrigerator while being defined with a plurality of refrigerating chambers therein, with a predetermined maximum refrigerating compartment temperature and a predetermined minimum refrigerating compartment temperature, respectively, thereby controlling a damper included in the refrigerator to be opened or closed and the circulating fan to be turned on or off such that the sensed refrigerating compartment temperature is ranged between the predetermined maximum and minimum refrigerating temperatures; and (C) discharging cold air into at least one of the refrigerating chambers when the damper is closed at the step (B) under a condition in which the compressor and the circulating fan are turned on at the step (A).

2. The temperature control method according to claim 1, wherein the step (A) further comprises the steps of turning on a compressor cooling fan included in the refrigerator when the compressor is turned on, while turning off the compressor cooling fan when the compressor is turned off.

3. The temperature control method according to claim 1, wherein the step (C) comprises the step of opening at least one nozzle installed such that an outlet thereof is openable to the at least one refrigerating compartment, for the discharge of the cold air.

4. The temperature control method according to claim 1, (D) further comprising the step of:

preventing cold air from being discharged into the at least one refrigerating chamber when the damper is opened at the step (B) under a condition in which the compressor and the circulating fan are turned on at the step (A).

5. The temperature control method according to claim 1, (D) further comprising the step of:

preventing cold air from being discharged into the at least one refrigerating chamber when the damper is opened at the step (B) under a condition in which the compressor is turned off, and the circulating fan is turned on at the step (A).

6. The temperature control method according to claim 1, (D) further comprising the step of:

preventing cold air from being discharged into the at least one refrigerating chamber when the damper is closed at the step (B) under a condition in which the compressor and the circulating fan are turned off at the step (A).

7. The temperature control method according to claim 1, wherein the step (A) comprises the steps of turning on the compressor and the circulating fan when the sensed freezing compartment temperature is equal to or more than the predetermined maximum freezing temperature, while turning off the compressor when the sensed freezing compartment temperature is less than the predetermined maximum freezing temperature.

8. The temperature control method according to claim 1, wherein:

the damper is opened when it is determined at the step (B) that the sensed refrigerating compartment temperature is equal to or more than the predetermined maximum refrigerating compartment temperature under a condition in which the compressor and the circulating fan are turned on at the step (A); and the damper is closed when it is determined at the step (B) that the sensed refrigerating compartment temperature is less than the predetermined maximum refrigerating compartment temperature under the condition in which the compressor and the circulating fan are turned on at the step (A).

9. The temperature control method according to claim 1, wherein:

the damper is opened, and the circulating fan is turned on, when it is determined at the step (B) that the sensed refrigerating compartment temperature is equal to or more than the predetermined maximum refrigerating compartment temperature under a condition in which the compressor is turned off at the step (A); and the damper is closed, and the circulating fan is turned off, when it is determined at the step (B) that the sensed refrigerating compartment temperature is less than the predetermined maximum refrigerating compartment temperature under the condition in which the compressor and the circulating fan are turned on at the step (A).

10. The temperature control method according to claim 1, wherein:

the predetermined maximum freezing compartment temperature corresponds to a temperature obtained by adding a predetermined temperature tolerance to a desired freezing compartment temperature set by the user; and the predetermined minimum freezing compartment temperature corresponds to a temperature obtained by deducting the predetermined temperature tolerance to the set freezing compartment temperature.

11. The temperature control method according to claim 1, wherein:

the predetermined maximum refrigerating compartment temperature corresponds to a temperature obtained by adding a predetermined temperature tolerance to a desired refrigerating compartment temperature set by the user; and the predetermined minimum refrigerating compartment temperature corresponds to a temperature obtained by deducting the predetermined temperature tolerance to the set refrigerating compartment temperature.

12. A temperature control method for a refrigerator comprising the steps of:

(A) comparing a sensed temperature of a freezing compartment defined in the refrigerator with a predetermined maximum freezing compartment temperature and a predetermined minimum freezing compartment temperature, respectively, thereby controlling a compressor and a circulating fan included in the refrigerator to be turned on or off such that the sensed freezing compartment temperature is ranged between the predetermined maximum and minimum freezing temperatures;

(B) comparing, following the step (A), a sensed temperature of a refrigerating compartment, defined in the refrigerator while being defined with a plurality of refrigerating chambers therein, with a predetermined maximum refrigerating compartment temperature and a predetermined minimum refrigerating compartment temperature, respectively, thereby controlling a damper included in the refrigerator to be opened or closed and the circulating fan to be turned on or off such that the sensed refrigerating compartment temperature is ranged between the predetermined maximum and minimum refrigerating temperatures; and (C) discharging cold air into at least one of the refrigerating chambers in response to an opening signal outputted from a nozzle timer included in the refrigerator when the damper is closed at the step (B) under a condition in which the compressor and the circulating fan are turned on at the step (A).

13. The temperature control method according to claim 12, further comprising the step of:

(D) preventing cold air from being discharged into the at least one refrigerating chamber in response to a closing signal outputted from the nozzle timer when the damper is closed at the step (B) under the condition in which the compressor and the circulating fan are turned on at the step (A).

14. The temperature control method according to claim 12, wherein the step (A) further comprises the steps of turning on a compressor cooling fan included in the refrigerator when the compressor is turned on, while turning off the compressor cooling fan when the compressor is turned off.

15. The temperature control method according to claim 12, wherein the step (C) comprises the step of opening, in response to the opening signal, at least one nozzle installed such that an outlet thereof is openable to the at least one refrigerating compartment, for the discharge of the cold air.

16. The temperature control method according to claim 12, wherein the step (A) comprises the steps of turning on the compressor and the circulating fan when the sensed freezing compartment temperature is equal to or more than the predetermined maximum freezing temperature, while turning off the compressor when the sensed freezing compartment temperature is less than the predetermined maximum freezing temperature.

17. The temperature control method according to claim 12, wherein:

the damper is opened when it is determined at the step (B) that the sensed refrigerating compartment temperature is equal to or more than the predetermined maximum refrigerating compartment temperature under a condition in which the compressor and the circulating fan are turned on at the step (A); and the damper is closed when it is determined at the step (B) that the sensed refrigerating compartment temperature is less than the predetermined maximum refrigerating compartment temperature under the condition in which the compressor and the circulating fan are turned on at the step (A).

18. The temperature control method according to claim 12, wherein:

the damper is opened, and the circulating fan is turned on, when it is determined at the step (B) that the sensed refrigerating compartment temperature is equal to or more than the predetermined maximum refrigerating compartment temperature under a condition in which the compressor is turned off at the step (A); and the damper is closed, and the circulating fan is turned off, when it is determined at the step (B) that the sensed refrigerating compartment temperature is less than the predetermined maximum refrigerating compartment temperature under the condition in which the compressor and the circulating fan are turned on at the step (A).

19. The temperature control method according to claim 12, wherein:

the predetermined maximum freezing compartment temperature corresponds to a temperature obtained by adding a predetermined temperature tolerance to a desired freezing compartment temperature set by the user; and the predetermined minimum freezing compartment temperature corresponds to a temperature obtained by deducting the predetermined temperature tolerance to the set freezing compartment temperature.

20. The temperature control method according to claim 12, wherein:

the predetermined maximum refrigerating compartment temperature corresponds to a temperature obtained by adding a predetermined temperature tolerance to a desired refrigerating compartment temperature set by the user; and the predetermined minimum refrigerating compartment temperature corresponds to a temperature obtained by deducting the predetermined temperature tolerance to the set refrigerating compartment temperature.

* * * * *